US007637849B2

(12) United States Patent
Chen

(10) Patent No.: US 7,637,849 B2
(45) Date of Patent: Dec. 29, 2009

(54) STEPPER EXERCISE APPARATUS

(75) Inventor: Tsung-Jen Chen, Chiayi (TW)

(73) Assignee: Shu-Hui Huang, Chiayi (TW)

( * ) Notice: Subject to any disclaimer, the term of this patent is extended or adjusted under 35 U.S.C. 154(b) by 0 days.

(21) Appl. No.: 12/431,586

(22) Filed: Apr. 28, 2009

(65) Prior Publication Data

US 2009/0280962 A1 Nov. 12, 2009

(30) Foreign Application Priority Data

May 12, 2008 (TW) ..... 97208151 U

(51) Int. Cl.
*A63B 22/04* (2006.01)

(52) U.S. Cl. ..... 482/52

(58) Field of Classification Search ..... 482/51, 482/52, 53, 54, 70, 71, 148; 434/253, 255; 601/29, 31, 34, 35; D12/670
See application file for complete search history.

(56) References Cited

U.S. PATENT DOCUMENTS 6,220,990 B1 * 4/2001 Crivello ..... 482/51
6,955,634 B1 * 10/2005 Lat ..... 482/71
7,465,255 B2 * 12/2008 Chen ..... 482/53
2002/0098950 A1 * 7/2002 Chen ..... 482/52
2004/0241631 A1 * 12/2004 Nizamuddin ..... 434/253
2005/0239606 A1 * 10/2005 Lin ..... 482/52
2007/0270284 A1 * 11/2007 Lin ..... 482/52
2008/0207406 A1 * 8/2008 Tsai ..... 482/52

* cited by examiner

*Primary Examiner*—Loan H Thanh
*Assistant Examiner*—Tam Nguyen
(74) *Attorney, Agent, or Firm*—Banger Shia

(57) ABSTRACT

A treadmill includes a base, two axle units, two pedal units and a coordinating unit. The base includes a post formed thereon. Each of the axle units includes an axle extended downwards from the post. Each of the pedal units includes a pedal pivotally connected to the axle of a related one of the axle units. The coordinating unit includes a pulley provided on the base and a rope wound round the pulley and formed with two ends each tied to a related one of the pedal units so that one of the pedal units is moved upwards and outwards while the other pedal unit is moved downwards and inwards.

6 Claims, 10 Drawing Sheets

STEPPER EXERCISE APPARATUS

FIELD OF INVENTION

The present invention relates to a treadmill with which a user can exercise his or her legs, buttocks and waist.

BACKGROUND OF INVENTION

A conventional treadmill includes two pedals that can be pivoted up and down about horizontal axles. The movement of the pedals is limited to vertical directions. Therefore, a user can only exercise his or her legs. Another conventional treadmill includes two pedals that can be pivoted about two inclined axles extended from a post. The inclined axles and the post form a Y-shaped structure. One of the pedals will be lifted and moved towards the post if the other pedal is trodden and moved away from the post, i.e., outwards. Therefore, a user is forced to twist his or her waist while exercising his or her legs by treading the pedals. The user uses a little energy to twist his or her waist because he or she easily keeps balance while moving the pedal downwards and outwards.

The present invention is therefore intended to obviate or at least alleviate the problems encountered in prior art.

SUMMARY OF INVENTION

It is the primary objective of the present invention to provide a treadmill with which a user can exercise his waist, buttocks and legs at the same time.

To achieve the foregoing objective, the treadmill includes a base, two axle units, two pedal units and a coordinating unit. The base includes a post formed thereon. Each of the axle units includes an axle extended downwards from the post. Each of the pedal units includes a pedal pivotally connected to the axle of a related one of the axle units. The coordinating unit includes a pulley provided on the base and a rope wound round the pulley and formed with two ends each tied to a related one of the pedal units so that one of the pedal units is moved upwards and outwards while the other pedal unit is moved downwards and inwards. Other objectives, advantages and features of the present invention will be apparent from the following description referring to the attached drawings.

BRIEF DESCRIPTION OF DRAWINGS

The present invention will be described via the detailed illustration of six embodiments referring to the drawings.

DETAILED DESCRIPTION OF EMBODIMENTS

Figure 1:
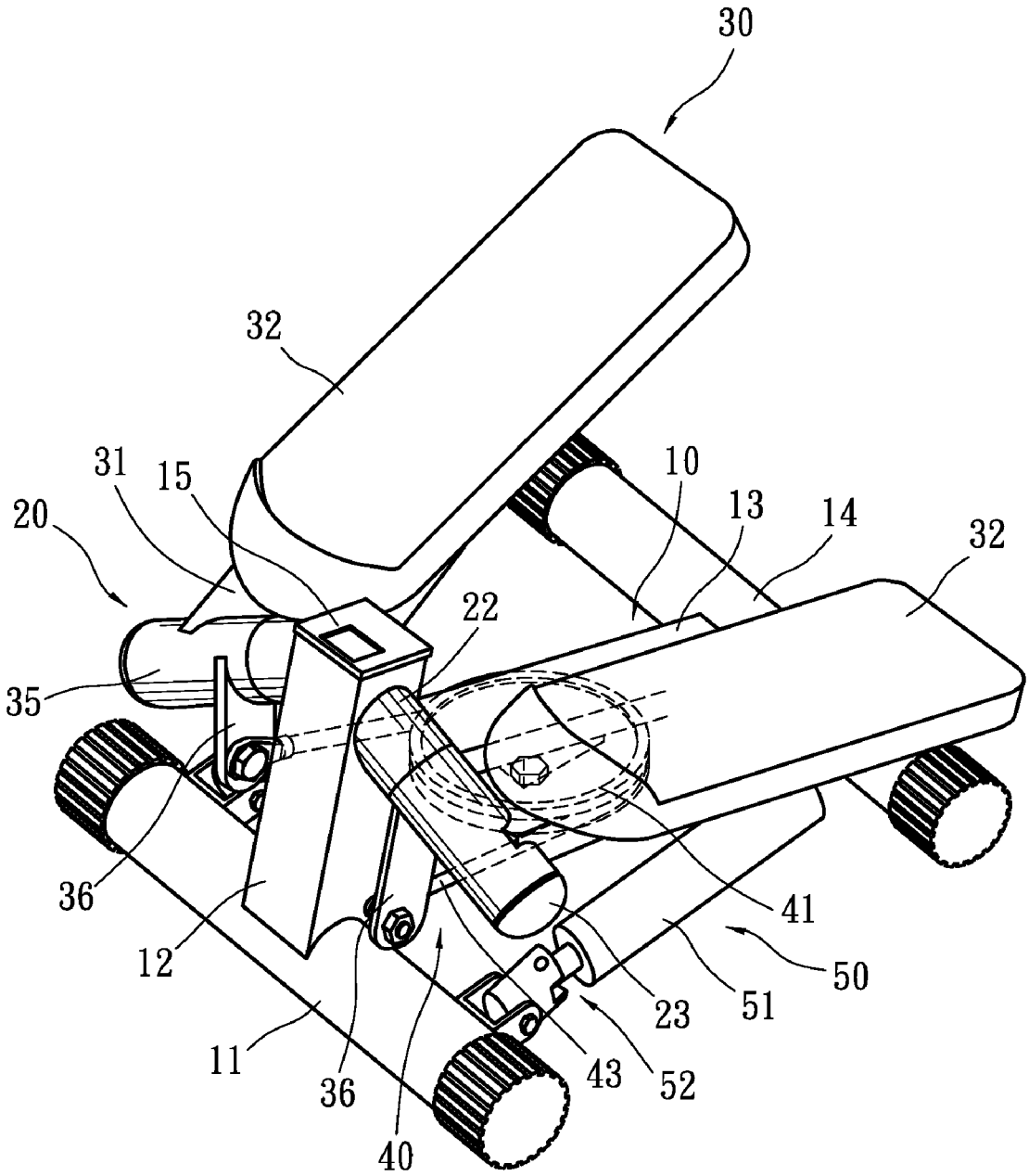
FIG. 1 is a perspective view of a compact treadmill according to the first embodiment of the present invention.
Figure 2:
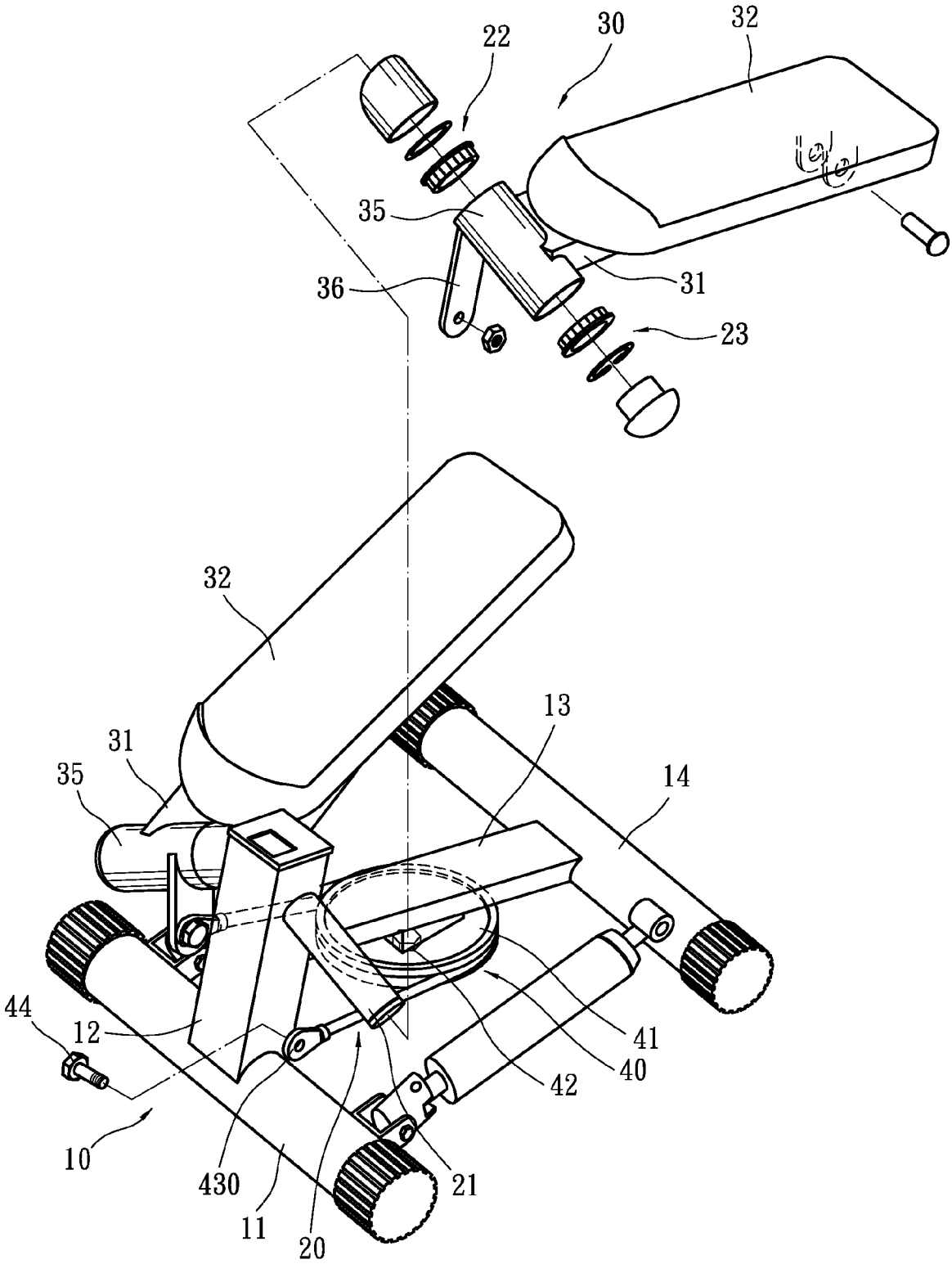
FIG. 2 is an exploded view of the compact treadmill shown in FIG. 1.
Figure 3:
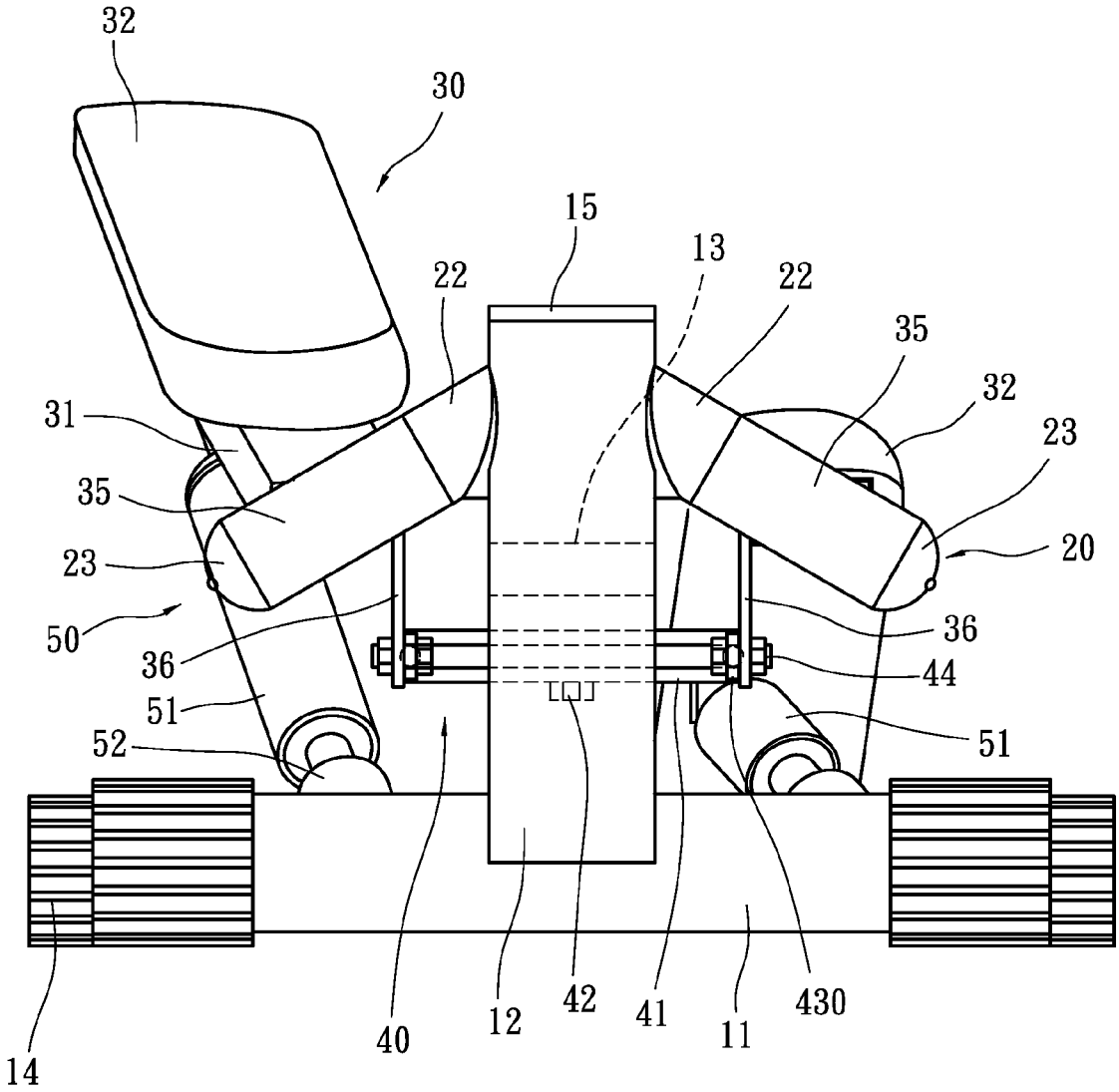
FIG. 3 is a front view of the compact treadmill shown in FIG. 1.
Figure 4:
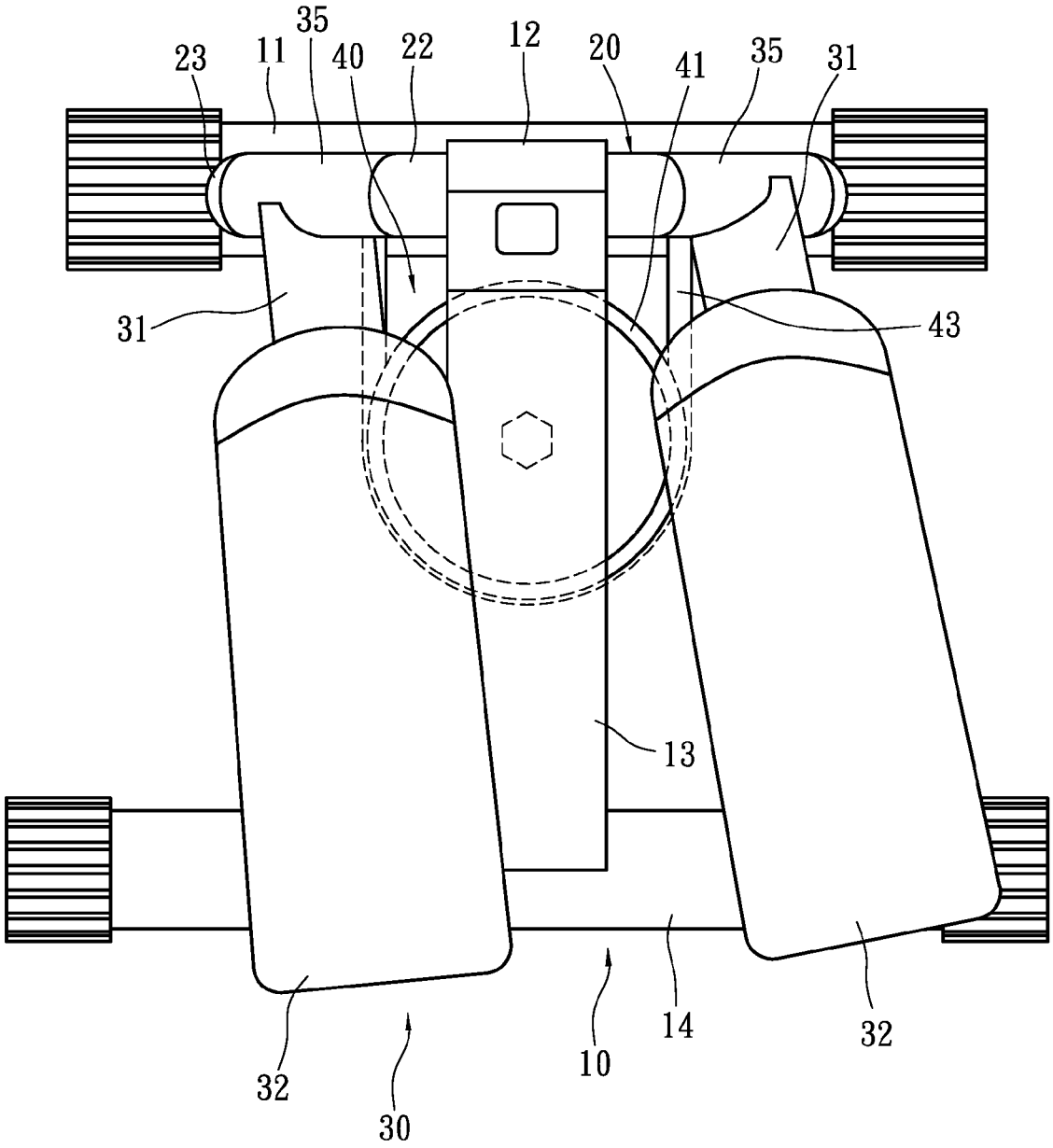
FIG. 4 is a top view of the compact treadmill shown in FIG. 1.

Referring to FIGS. 1 through 4, a treadmill includes a base 10, two axle units 20, two pedal units 30, a coordinating unit 40 and two impeding units 50 according to a first embodiment of the present invention. The base 10 includes two crossbars 11 and 14, a post 12 raised from the crossbar 11 and a longitudinal bar 13 provided between the post 12 and the crossbar 14. A meter 15 is provided on the post 12. Each of the axle units 20 includes an axle 21 extended downwards from the post 12. The axle 21 includes a fixed end at the post 12 and a free end opposite to the fixed end. The free end is located lower than the fixed end.

Each of the pedal units 30 includes a sleeve 35 pivotally provided on a related one of the axles 21 with two bearings 22 and 23, a beam 31 connected to the sleeve 35, a pedal 32 provided on the beam 31 and a connector 36 connected to the sleeve 35. Thus, the pedal units 30 are pivotally provided on the axle units 20.

The coordinating unit 40 includes a pulley 41 and a rope 43 wound around the pulley 41. The pulley 41 is connected to the longitudinal bar 13 with a fastener 42. The rope 43 is formed with two ends each tied to a washer 430. A fastener 44 is driven into the connector 36 of each of the pedal units 30 through a related one of the washers 430. Thus, the pedal units 30 are connected to each other with the coordinating unit 40 so that one of the pedals 32 will be moved upwards and outwards if the other pedal 32 is moved downwards and inwards. Each of the impeding units 50 includes a hydraulic cylinder 51 and a universal joint 52 for connecting an end of the hydraulic cylinder 51 to the crossbar 11. An opposite end of the hydraulic cylinder 51 is connected to the beam 31 of a related one of the pedal units 30. Thus, each of the impeding units 50 is used to exert impedance against the movement of a related one of the pedal units 30.

Figure 5:
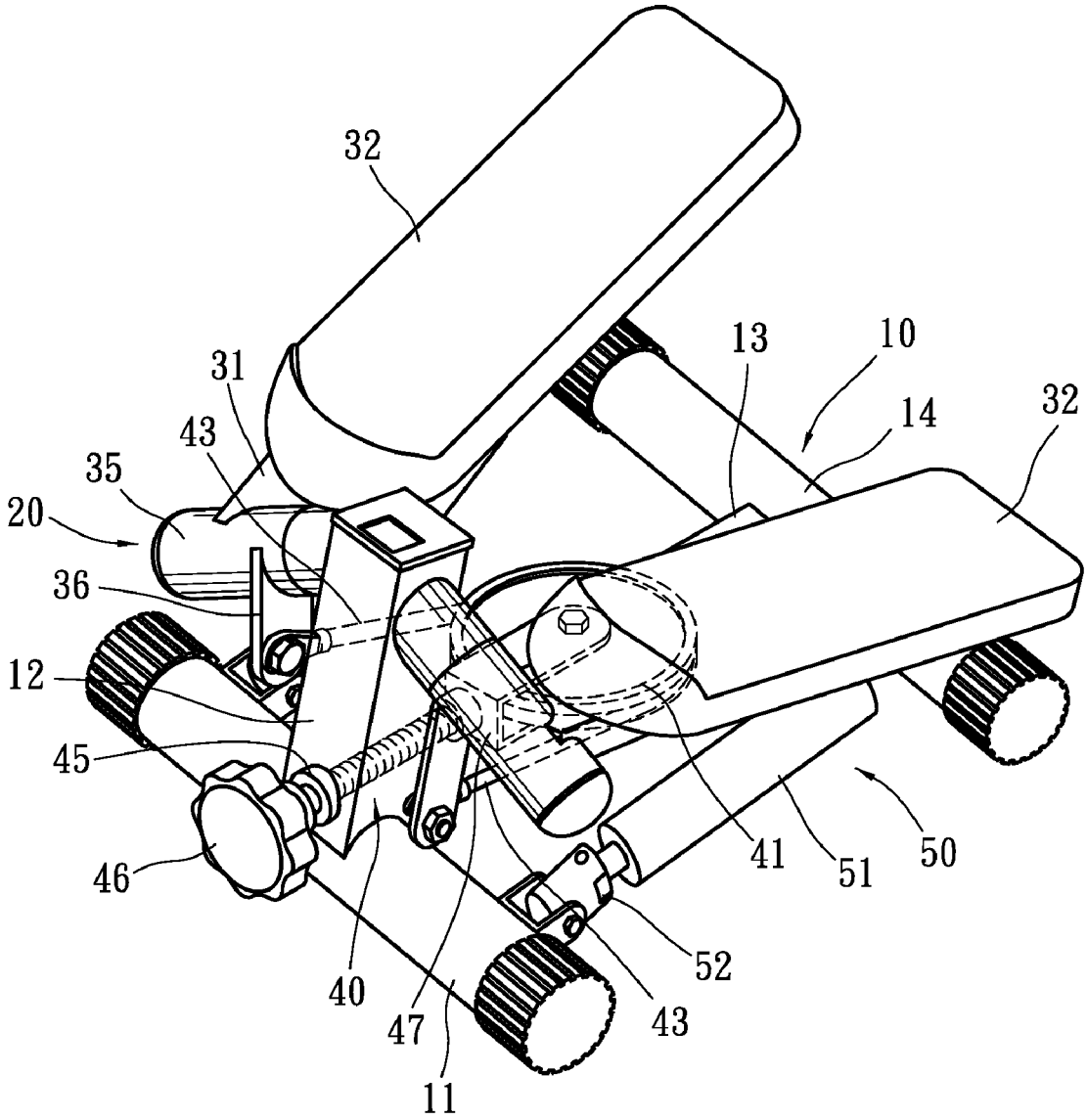
FIG. 5 is a perspective view of a compact treadmill according to the second embodiment of the present invention.
Figure 6:
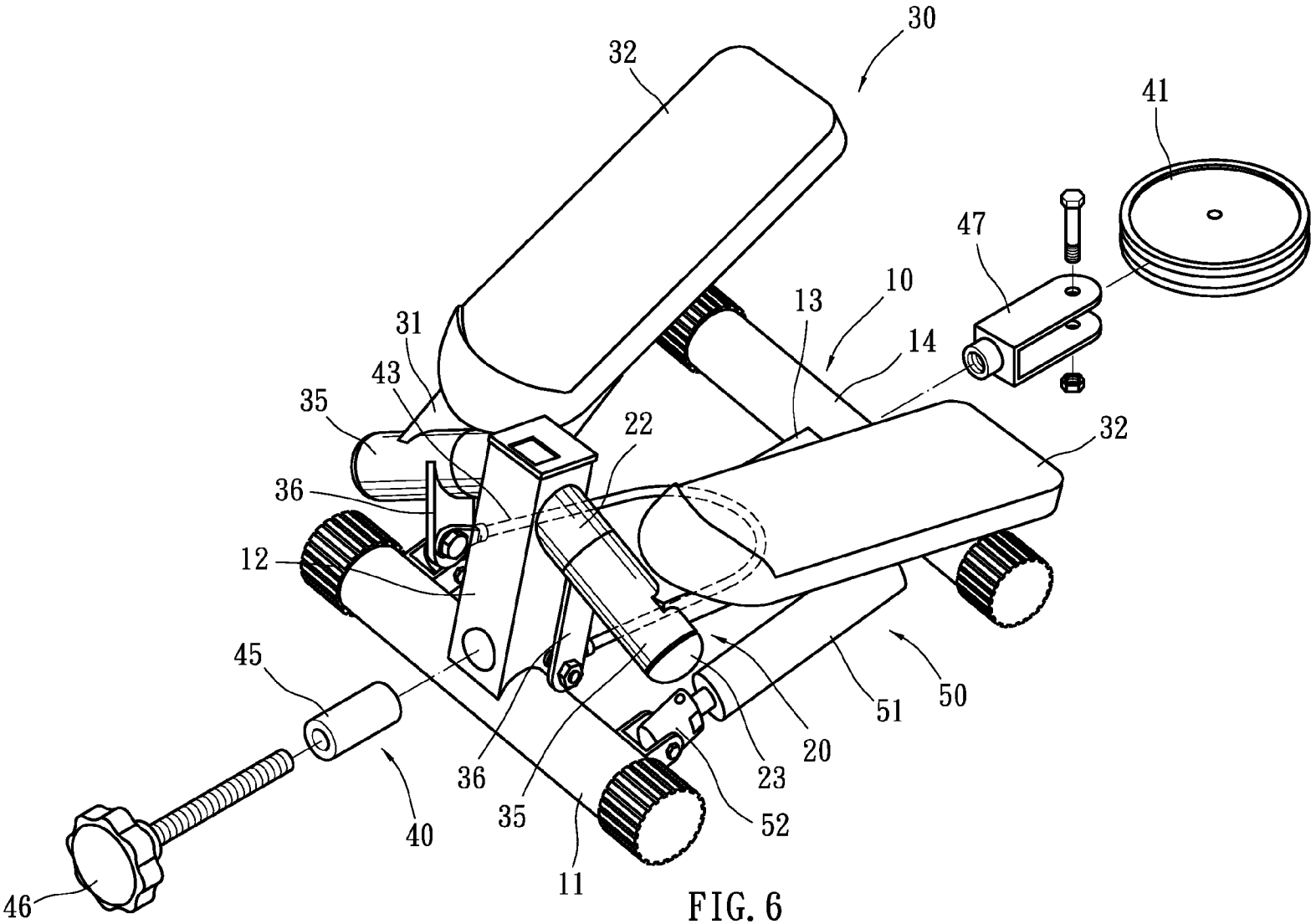
FIG. 6 is an exploded view of the compact treadmill shown in FIG. 5.
Figure 7:
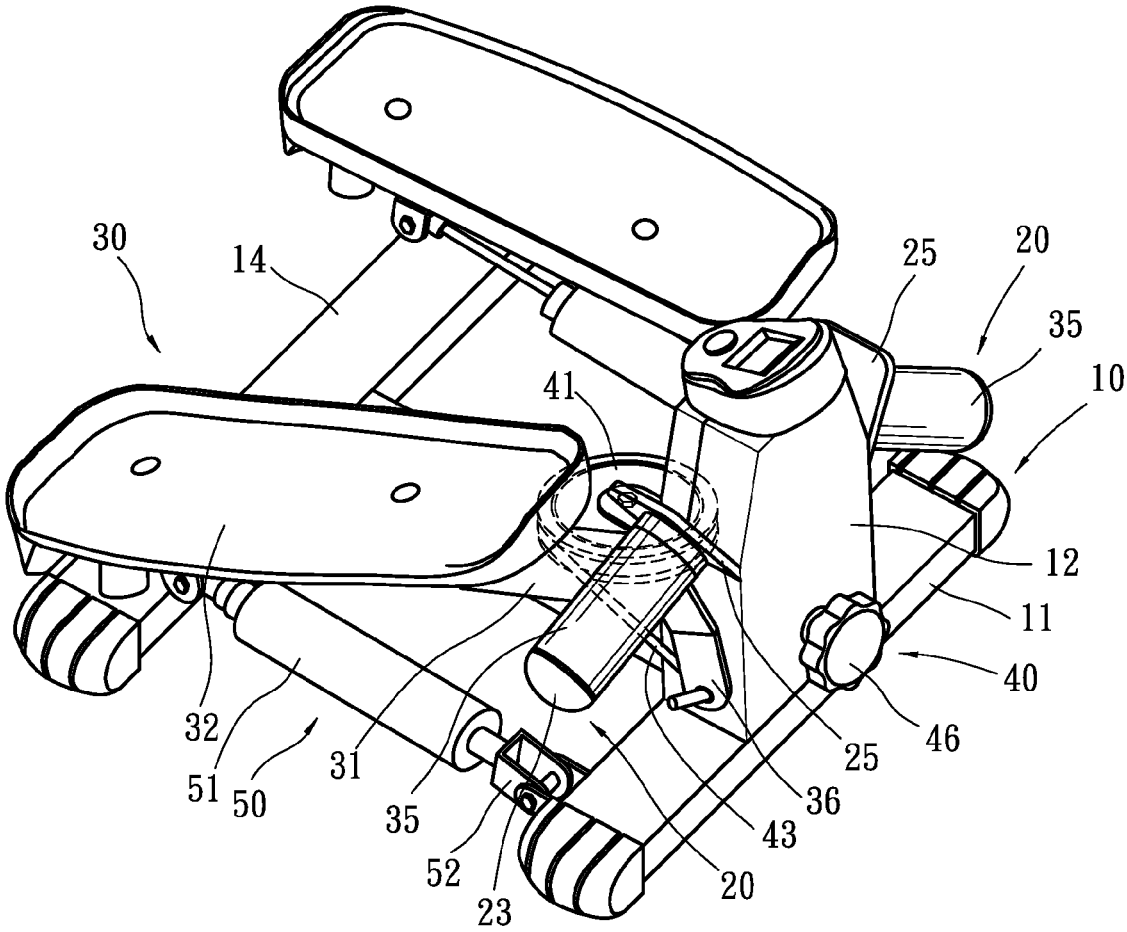
FIG. 7 is a perspective view of a compact treadmill according to the third embodiment of the present invention.
Figure 8:
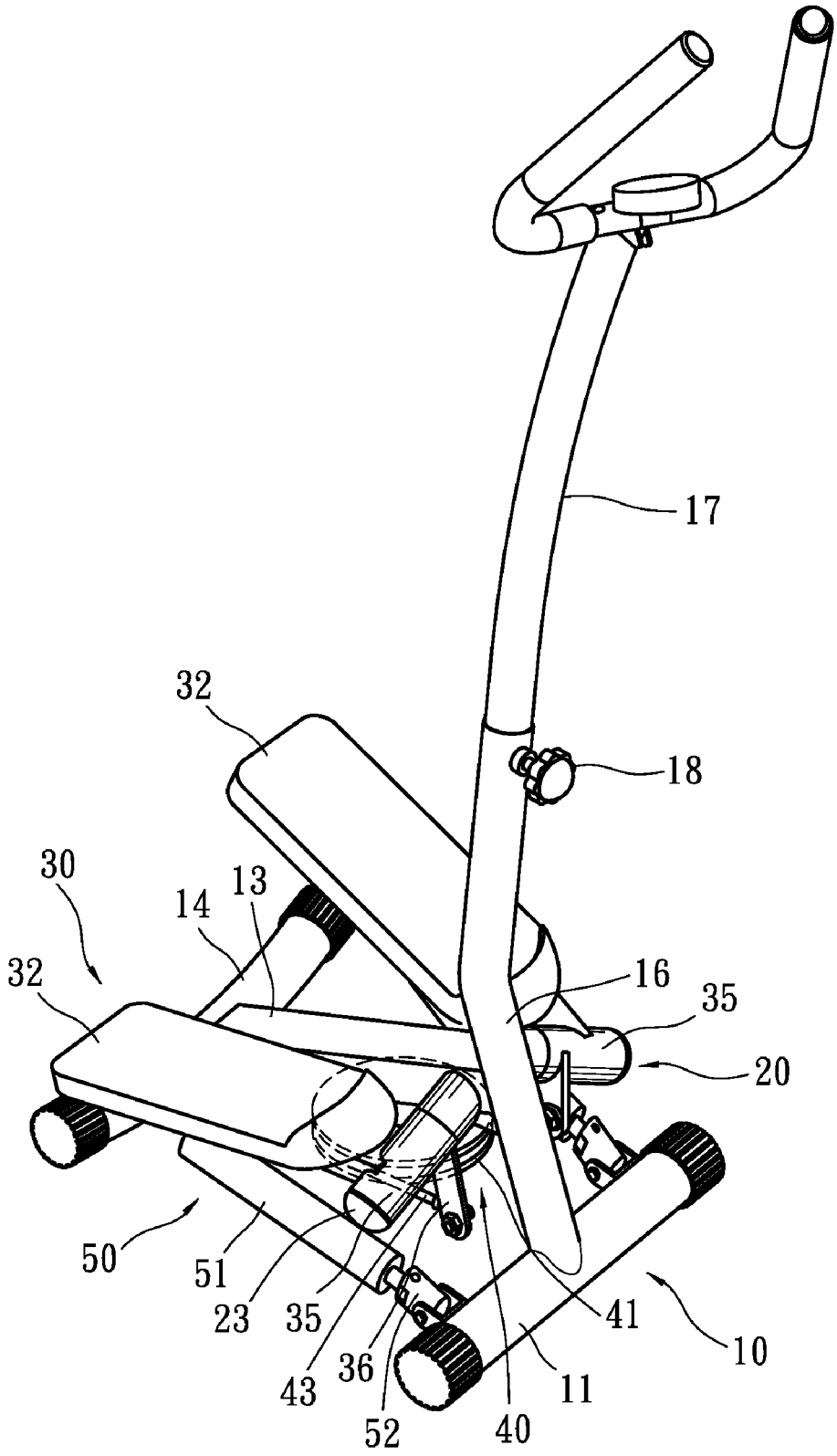
FIG. 8 is a perspective view of a compact treadmill according to the fourth embodiment of the present invention.

Referring to FIGS. 5 and 6, there is shown a treadmill according to a second embodiment of the present invention. The second embodiment is identical to the first embodiment except that the coordinating unit 40 includes a fork 47 for supporting the pulley 41, a threaded bolt 46 rotationally connected to the fork 47 and driven through the post 12 and a nut 45 engaged with the threaded bolt 46 and non-rotationally attached to the post 12. As the threaded bolt 46 is rotated in the nut 45, the position of the fork 47, the pulley 41 and the rope 43 is adjusted so that the angles of the pedals 32 are adjusted. Accordingly, the fastener 42 is omitted. Referring to FIG. 7, there is shown a treadmill according to a third embodiment of the present invention. The third embodiment is like the second embodiment except including two tabs 25 extended upwards from the post 12. Each of the axles 21 is connected to a related one of the tabs 25 so that they axles 21 are directed downwards. Referring to FIG. 8, there is shown a treadmill according to a fourth embodiment of the present invention. The fourth embodiment is identical to the first embodiment except including a tube 16 instead of the post 12, a post 17 telescopically inserted in the tube 16 and a handle supported on the post 17. The post 17 is secured in the tube 16 with a fastener 18. A child, a pregnant woven or a senior citizen can hold the handle to keep balance while exercising.

Figure 9:
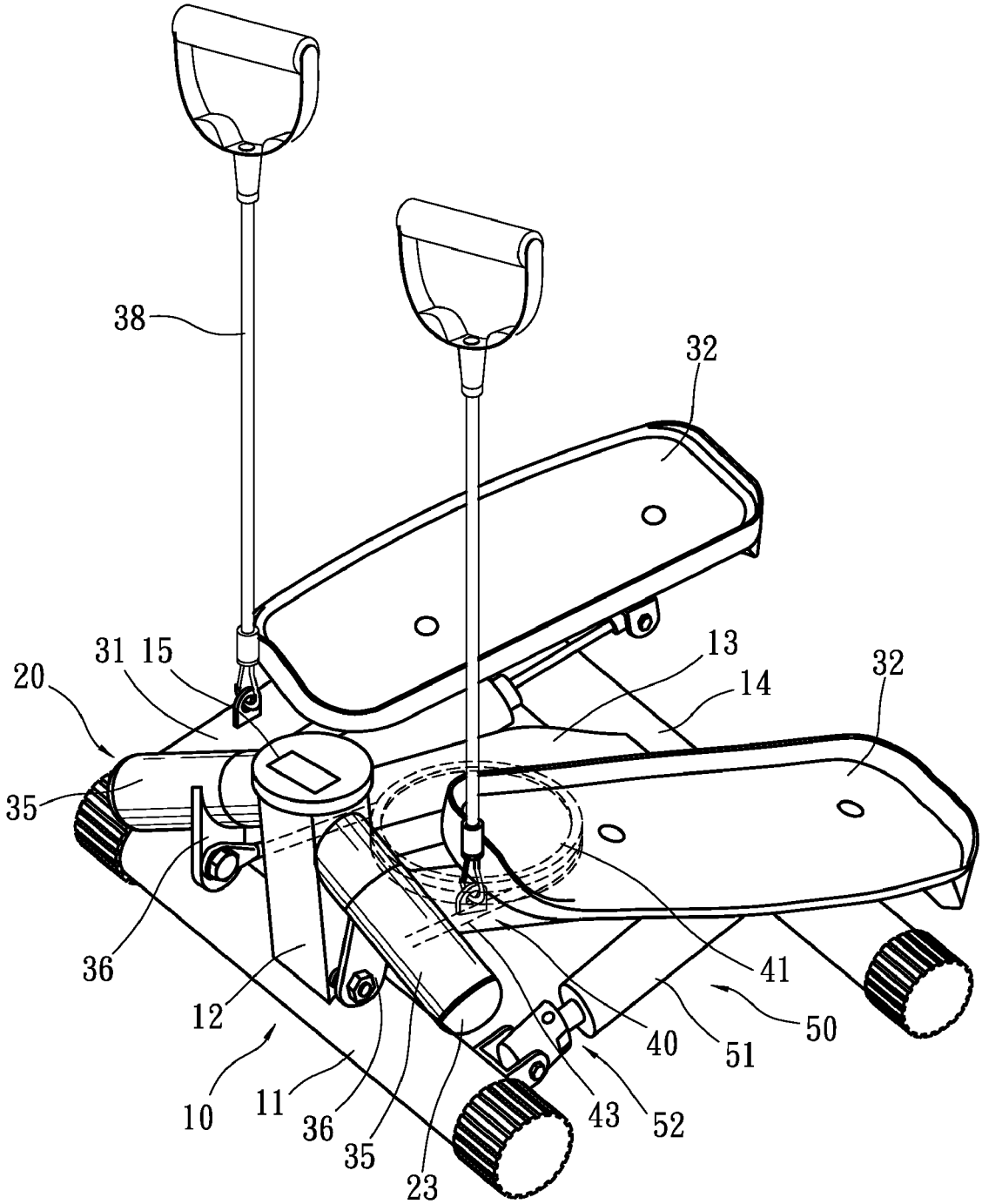
FIG. 9 is a perspective view of a compact treadmill according to the fifth embodiment of the present invention.

Referring to FIG. 9, there is shown a treadmill according to a fifth embodiment of the present invention. The fifth embodiment is identical to the first embodiment except including two elastic strings 38 each tied to a related one of the beams 31. A user can exercise his or her arms by pulling the elastic strings 38.

Figure 10:
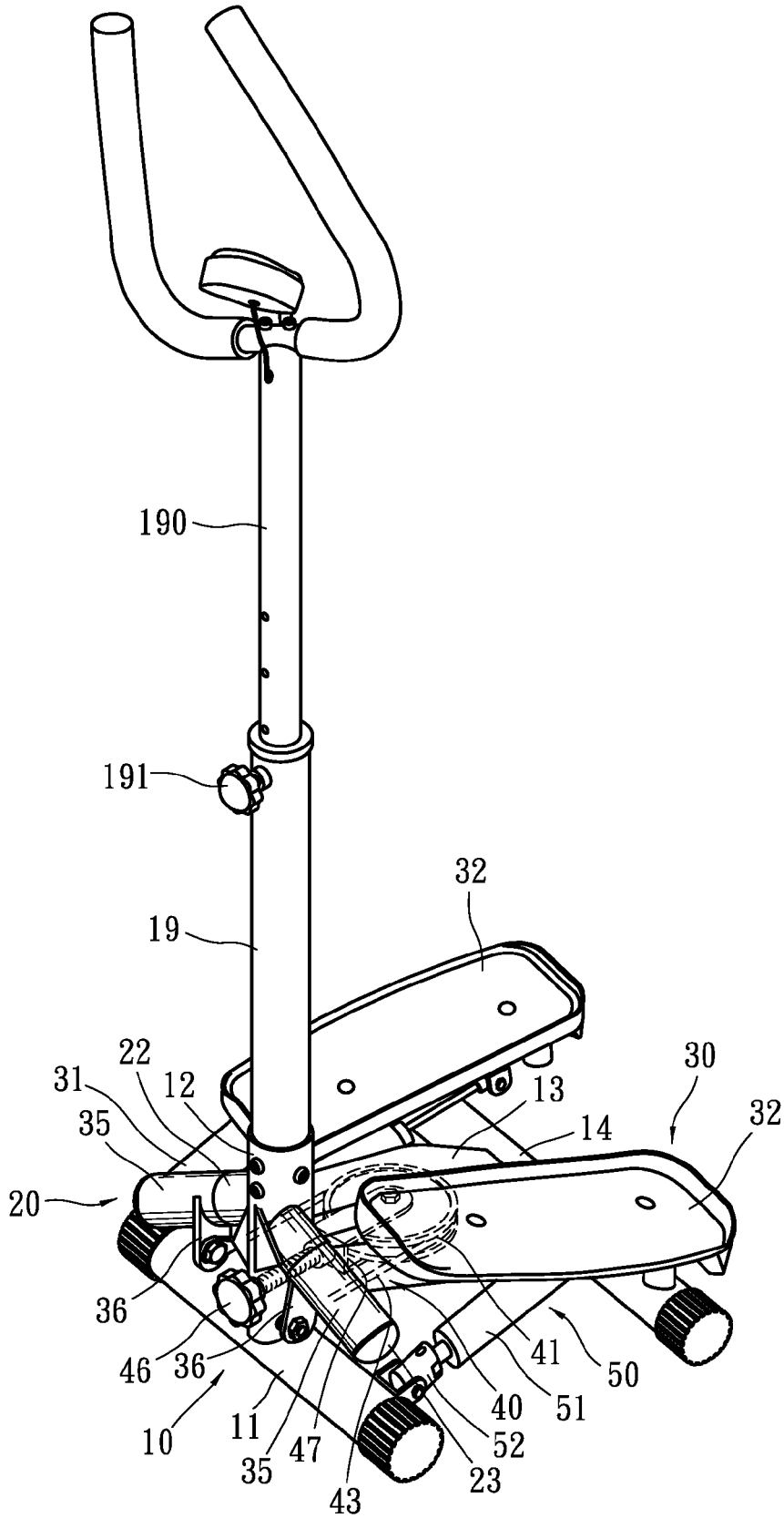
FIG. 10 is a perspective view of a compact treadmill according to the sixth embodiment of the present invention.

Referring to FIG. 10, there is shown a treadmill according to a sixth embodiment of the present invention. The sixth embodiment is like the second embodiment except including a tube 19 instead of the post 12, a post 190 telescopically inserted in the tube 19 and a handle supported on the post 190. The post 190 is secured in the tube 19 with a fastener 191. A child, a pregnant woven or a senior citizen can hold the handle to keep balance while exercising.

The present invention has been described via the detailed illustration of the embodiments. Those skilled in the art can derive variations from the embodiments without departing from the scope of the present invention. Therefore, the embodiments shall not limit the scope of the present invention defined in the claims.

The invention claimed is:

1. A stepper exercise apparatus comprising:

a base, adapted to rest upon a support surface, comprising an upright post formed thereon;

two axle units, each comprising an axle wherein one axle is extended laterally downwards from a flank of the upright post and the other axle is extended laterally downwards on an opposite flank of the post, and each axle includes an end fixed at the post and a free end opposite to the fixed end with the free end being located lower that the fixed end relative to the support surface;

two pedal units each pivotally connected to the axle of a related one of the axle units; and a coordinating unit comprising a pulley provided on the base and a rope wound around the pulley and formed with two ends each tied to a related one of the pedal units so that during exercise, as one of the pedal units is moved upwards and laterally outwards the other pedal unit is moved downwards and laterally inwards.

2. The stepper exercise apparatus according to claim 1 comprising a fastener for fastening the pulley to the base.

3. The stepper exercise apparatus according to claim 1, wherein each of the pedal units comprises a pedal pivotally connected to a related one of the axles and a connector extended from the pedal, wherein the coordinating unit comprises two washers each connected to an end of the rope and two fasteners each driven into the connector of a related one of the pedal units through a related one of the washers.

4. The stepper exercise apparatus according to claim 1, wherein the coordinating unit comprises:

a nut non-rotationally attached to the post;

a threaded bolt engaged with the nut; and a fork rotationally connected to the threaded bolt, wherein the pulley is supported on the fork.

5. The stepper exercise apparatus according to claim 1 comprising two impeding units each for exerting impedance against the movement of the pedal of a related one of the pedal units.

6. The stepper exercise apparatus according to claim 1 comprising two elastic strings each comprising a lower end connected to a related one of the pedal units and an upper end connected to a handle to be held by a use so that such a user can exercise the arms by pulling the elastic strings.

* * * * *